US007878037B2

(12) United States Patent
Flehmig et al.

(10) Patent No.: US 7,878,037 B2
(45) Date of Patent: Feb. 1, 2011

(54) DEVICE FOR THE FREE FORMING AND BENDING OF LONGITUDINAL PROFILES, PARTICULARLY PIPES, AND A COMBINED DEVICE FOR FREE FORMING AND BENDING AS WELL AS DRAW-BENDING LONGITUDINAL PROFILES, PARTICULARLY PIPES

(75) Inventors: Thomas Flehmig, Ratingen (DE); Martin Kibben, Dinslaken (DE); Urs Kühni, Sumiswald (CH); Jacob Ziswiler, Nidau (CH)

(73) Assignees: ThyssenKrupp Steel Europe AG, Duisburg (DE); Mewag Maschinenfabrik AG, Wasen im Emmental (CH)

( * ) Notice: Subject to any disclaimer, the term of this patent is extended or adjusted under 35 U.S.C. 154(b) by 389 days.

(21) Appl. No.: 11/909,427

(22) PCT Filed: Mar. 20, 2006

(86) PCT No.: PCT/EP2006/002523

§ 371 (c)(1),
(2), (4) Date: Feb. 15, 2008

(87) PCT Pub. No.: WO2006/100012

PCT Pub. Date: Sep. 28, 2006

(65) Prior Publication Data

US 2009/0126441 A1 May 21, 2009

(30) Foreign Application Priority Data

Mar. 22, 2005 (DE) ..... 10 2005 013 750

(51) Int. Cl.
*B21D 7/02* (2006.01)

(52) U.S. Cl. ..... 72/217; 72/150; 72/219; 72/307

(58) Field of Classification Search ..... 72/31.04, 72/31.05, 127, 149, 150, 214, 215, 217, 219, 72/306, 307, 369, 387, 388
See application file for complete search history.

(56) References Cited

U.S. PATENT DOCUMENTS 5,042,282 A * 8/1991 Kimura ..... 72/217

(Continued)

FOREIGN PATENT DOCUMENTS

DE 152 7 425 10/1969

(Continued)

(Continued)

OTHER PUBLICATIONS

International Search Report for PCT/EP2006/002523.

*Primary Examiner*—Edward Tolan
(74) *Attorney, Agent, or Firm*—Proskauer Rose LLP

(57) ABSTRACT

A device for the free-form bending of longitudinal profiles, in particular pipes, in which an axial sleeve is arranged downstream of a feed unit in its direction of feed. Arranged downstream of the axial sleeve in the direction of feed, is a bending sleeve. The feed unit and the axial sleeve in each case have a drive pointing in the direction of feed, wherein the axial sleeve can be adjusted independently of the feed unit. The feed unit and the axial sleeve further have rotary drives for the simultaneous rotation in the same direction of the longitudinal profile held and guided by them. The bending sleeve can only be adjusted in a translatory manner by means of a drive in an axis running transverse to the axis of the longitudinal profile and the feed device. In addition to this, it can be pivoted by means of a drive about an axis lying transverse to the axis of the longitudinal profile and the feed device. The bending sleeve is additionally mounted so as to freely rotate in sympathy with the guide sleeve or is braked in relation to it.

8 Claims, 3 Drawing Sheets

U.S. PATENT DOCUMENTS

| | | | | |
|---|---|---|---|---|
| 5,111,675 | A | 5/1992 | Murata | |
| 6,434,993 | B1 * | 8/2002 | Broggi et al. | 72/157 |
| 6,434,995 | B1 * | 8/2002 | Kataoka et al. | 72/307 |
| 6,711,927 | B2 * | 3/2004 | Furuyama et al. | 72/217 |
| 7,104,100 | B2 * | 9/2006 | Saegusa | 72/149 |
| 7,134,310 | B2 * | 11/2006 | Hu | 72/307 |
| 7,174,760 | B2 * | 2/2007 | Hu | 72/157 |

FOREIGN PATENT DOCUMENTS

| | | |
|---|---|---|
| DE | 295 19 048 | 1/1996 |
| DE | 102 49 315 | 5/2004 |
| DE | 103 30 753 | 2/2005 |
| EP | 092 8 646 | 7/1999 |
| EP | 108 7 278 | 3/2001 |
| JP | 041 27 919 | 7/1992 |
| WO | WO 2004/035241 | 4/2004 |

* cited by examiner

DEVICE FOR THE FREE FORMING AND BENDING OF LONGITUDINAL PROFILES, PARTICULARLY PIPES, AND A COMBINED DEVICE FOR FREE FORMING AND BENDING AS WELL AS DRAW-BENDING LONGITUDINAL PROFILES, PARTICULARLY PIPES

CROSS-REFERENCE TO RELATED APPLICATIONS

This application is a National Phase Application of International Application No. PCT/EP2006/002523, filed Mar. 20, 2006, which claims the benefit of and priority to German Application No. 10 2005 013 750.4, filed Mar. 22, 2005, which is owned by the assignee of the instant application. The disclosure of each of the above applications is incorporated herein by reference in its entirety.

FIELD OF THE INVENTION

The invention relates to a device for the free-form bending of longitudinal profiles, with a feed unit taking up the longitudinal profile, with an axial sleeve arranged downstream of the feed unit in the direction of feed taking up the longitudinal profile by positive and/or non-positive attachment, and with a bending sleeve arranged downstream of the axial sleeve in the direction of feed, with a passage aperture for the longitudinal profile adapted to the outer contour of the longitudinal profile, wherein the bend guide element can be adjusted in linear fashion by means of adjustment drives in a plane lying orthogonally to the axis of its passage aperture, and can be pivoted about an axis perpendicular both to the axis of the passage aperture as well as to the direction of linear movement, and wherein the axial sleeve is equipped with a drive with which its distance interval from the bending sleeve can be adjusted.

BACKGROUND OF THE INVENTION

Two main methods for the bending of longitudinal profiles are free-form bending and draw bending. In a device for draw bending, the longitudinal profile is taken up at the front end and drawn around a template, wherein the template specifies the bending radius. The decisive disadvantage with draw bending lies in the fact that the longitudinal profile can be bent within a radius only in one plane. The bending radius is also restricted when it is determined by the template. By contrast, with a device for free-form bending, there are many degrees of freedom available. In particular, in a device for free-form bending without the adaptation of device parts, both different and constant bending radii can be achieved, as well as variable radii as space curves. A disadvantage, however, is seen in the high apparatus expenditure required for this, and the downwards limitation due to small radii.

One known device for free-form bending (DE 697 22 944 T2) differs from the device described in the preamble in that the axial sleeve guiding the longitudinal profile is arranged stationary, and thus its distance interval in relation to the bending sleeve is not adjustable. The bending sleeve is mounted on a cross-slide, with which it can be adjusted in two orthogonal axes arranged transverse to the longitudinal axis of the longitudinal profile. In addition to this, the bend guide element can be pivoted about two axes running relative to one another and perpendicular to the axis of their passage aperture. Finally, it can be rotated about the axis of its passage aperture. For all these movement possibilities, individual drives and bearings are provided. In order to accommodate these parts at the bend guide element, a substantial amount of space is required. This space imposes a not insubstantial limit on the smallest possible bending radius. In addition to this, the expenditure on the technical mechanical engineering resources is relatively high.

With a known device for the free-form bending of the type referred to in the preamble (DE 102 49 315 A1), the bending sleeve is likewise mounted on a cross-slide, so that it can be adjusted in two orthogonal axes transverse to the longitudinal axis of the longitudinal profile. In addition to this, the bending sleeve can be pivoted about an axis running perpendicular to the axis of its passage aperture. Finally, it can be rotated about the axis of its passage aperture. As with the known device described heretofore, a substantial amount of space is required to accommodate all these parts and drives, at the expense of the smallest possible bending radius. The technical mechanical engineering arrangement is also correspondingly elaborate.

SUMMARY OF THE INVENTION

The invention, in one embodiment, features a device for the free-form bending of longitudinal profiles, in particular pipes, which is simpler in its design outlay than the known device and also allows for very small bending radii.

A device of the type referred to in the preamble can be provided that both the feed unit and the axial sleeve are driven by rotary drives in the same direction and simultaneously relative to the bending sleeve, in that the bending sleeve is mounted so as to be rotatable about the axis of its passage aperture and is either freely rotating in sympathy with the axial sleeve or can be braked in a controlled manner in relation to it.

Due to the reduction of the settings and relative movements required for the free-form bending—the axial sleeve requires only one drive for a translational movement and one drive for a pivot movement with corresponding bearings, while for the rotatable or controlled braked mounting of the bending sleeve only one brake needs to be provided and the initiation of a bending movement in the space is formed by the rotation of the longitudinal profile with a simultaneous rotation of the feed unit and of the axial sleeve—a very simple structural design is derived and a short structural length. In interaction with the fact that the distance interval between the bending sleeve and the axial sleeve can be individually adjusted for each bending situation, there is the possibility that longitudinal profiles, in particular pipes, can be bent with comparatively small bending radii.

According to one embodiment of the invention, the feed unit is designed in an inherently known manner as a grip tongs equipped with a feed drive.

In order to avoid the risk of a fold in the longitudinal profile being guided by the feed unit to the axial sleeve, provision can be made for support means in the area between the feed unit and the axial sleeve, which hold the longitudinal profile exactly in the profile axis. In order to prevent a collision between these support means and the feed unit which moves forwards during the bending, these support means must be designed in such a way that they are clear of the path of the feed unit. Well-suited for this purpose, in particular, is a plurality of supporting shoes arranged one behind another, which can be opened and moved to the side.

In order to avoid a collapse with longitudinal profiles, in particular a pipe, during bending, it is possible for an interior mandrel to be arranged in the bending area in and after the axial sleeve, capable of bending as far as into the bending sleeve, the axial position of which can be adjusted and controlled from the rear end of the feed unit by means of a mandrel rod provided with the drive.

The device according to the invention for the free-forming bending of longitudinal profiles is well-suited, in particular because of the splitting described of the different adjustments required for the free-forming bending, with drives and bearings for this purpose, to be combined with a device for draw bending, since parts of the device can be used both for free-form bending as well as for draw bending. It is, however, also possible for devices for free-form bending other than those according to the invention to be combined with a device for draw bending in accordance with this solution according to the invention.

With the device for the bending of longitudinal profiles, in particular pipes, according to this solution, which has a feed unit taking up the longitudinal profile and an axial sleeve arranged downstream of the feed unit in the direction of feed and taking up the longitudinal profile by positive and/or non-positive attachment, two bending units of different types are arranged next to one another on a guide frame and can be moved on the guide frame transverse to the axis of the longitudinal profile, alternating from a working position in front of the axial sleeve into a parked position to the side of this. In this situation, for freeform bending a bending unit is formed with the axial sleeve and the feed unit, in particular with the features described heretofore, while the other bending unit is designed as a draw bending device.

With such a combined device for free-form bending and draw bending, only the bending units are of different design, while the other device parts which require a not inconsiderable technical mechanical engineering effort and expenditure are the same for both bending devices. Such a device can then always be used economically if average unit numbers of bent longitudinal profiles are required or if the investment volume is to be kept low.

BRIEF DESCRIPTION OF THE DRAWINGS

The invention is described in greater detail hereinafter on the basis of drawings representing an embodiment. These show, specifically.

DESCRIPTION OF THE INVENTION

Figure 1:
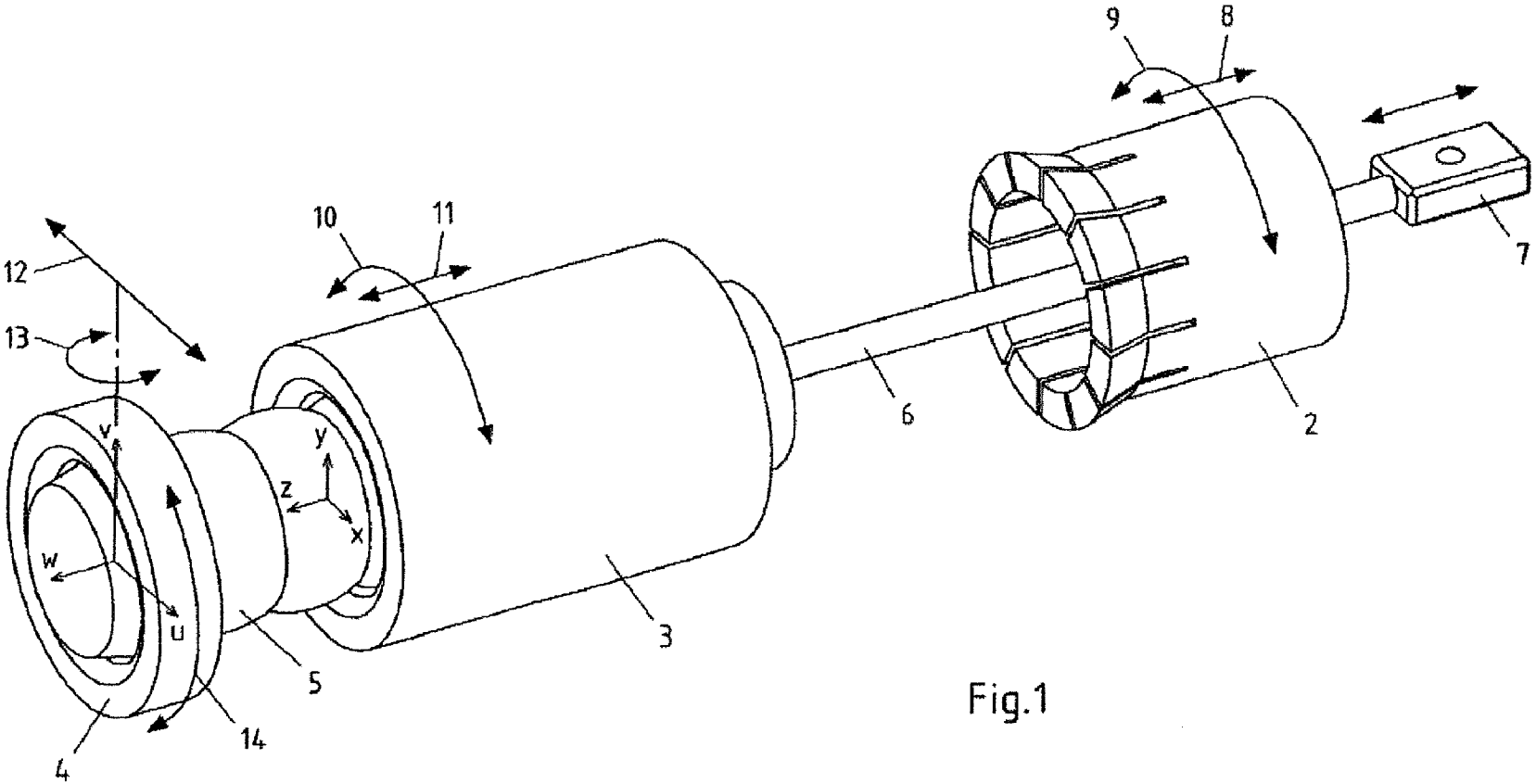
FIG. 1 A device for free-form bending, with its essential parts and drives, in a highly diagrammatical form, in an isometric representation obliquely from above, FIG. 2 The device according to FIG. 1, with a pipe to be bent, in an isometric representation obliquely from above, from another viewing angle to that in FIG. 1, FIG. 3 A combined device for free-form bending and draw bending, in a diagrammatic view from above.
Figure 2:
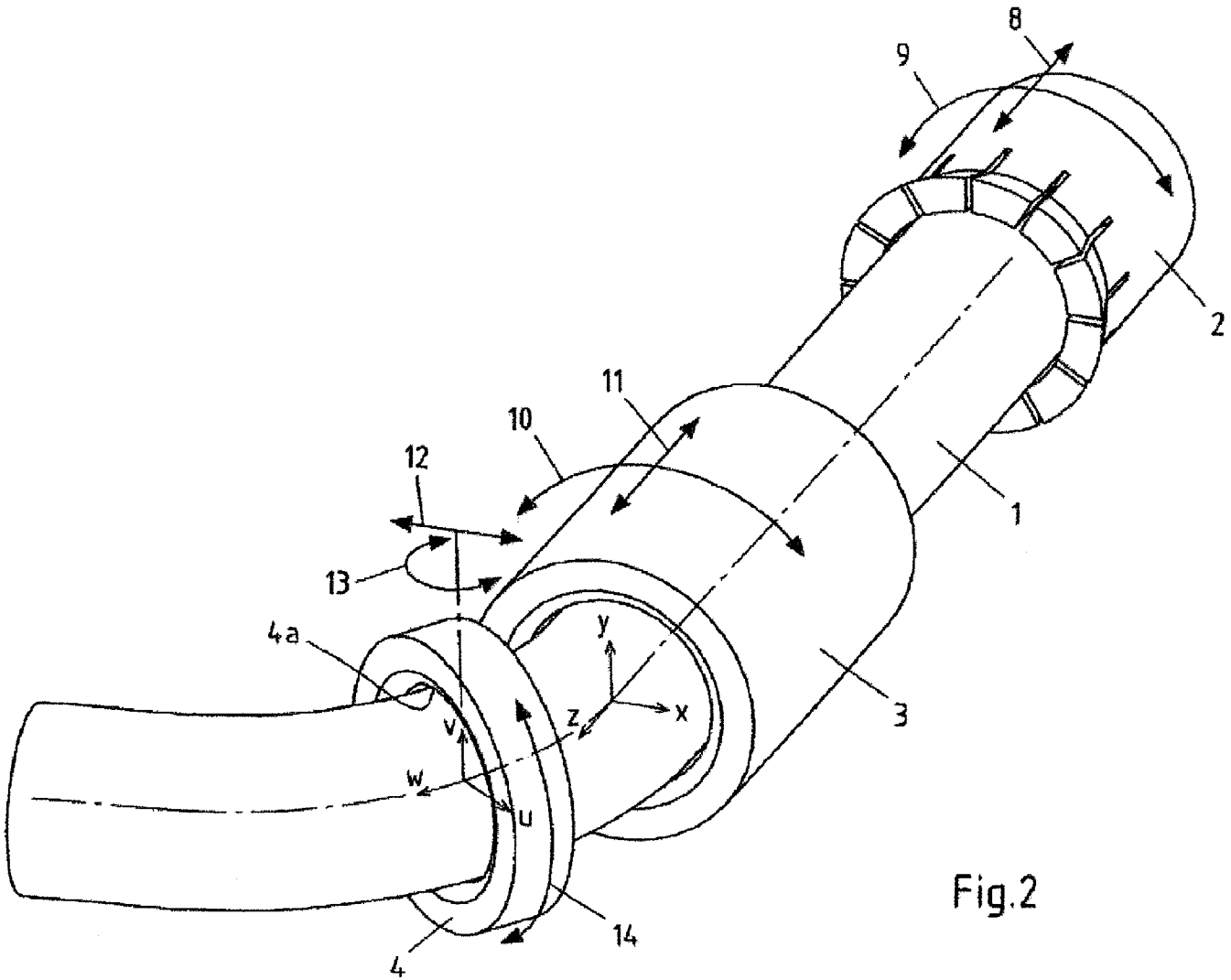

The device represented in FIGS. 1 and 2, for the free-form bending of a longitudinal profile 1, in particular of a pipe, has a feed unit 2 in the form of an inherently known grip tongs, an axial sleeve 3 arranged upstream of this in the direction of feed, and a bending sleeve 4, arranged in turn upstream of this in the direction of feed, with a passage aperture 4*a*. The bending sleeve can be designed as a sliding sleeve but can also have a roller guide. Both alternatives serve to allow the pipe 1 to be moved with the least possible friction through the passage aperture 4*a*. In the pipe 1, in the area of the axial sleeve 3 and the bending sleeve 4, where the bending takes place, is a flexible mandrel 5, which is held at the rear end of the pipe 1 by means of a mandrel rod 6. The mandrel rod 6 is connected to a drive 7, with the result that the mandrel 5 is axially adjustable and controllable.

The feed unit 2, designed in particular as a pipe grip tongs, has an axial drive 8, represented in the drawing in diagrammatic form by a double arrow. In addition to this, the feed unit 2 has a rotary drive 9, represented by a double arrow.

Likewise allocated to the axial sleeve 3 is a rotary drive 10, which is represented by a double arrow. The rotary drives 9 and 10 rotate in the same direction and simultaneously. In addition to this, allocated to the axial sleeve 3 is an axial drive 11, which is represented by a double arrow. The axial drives 8 and 11 operate independently of one another. The distance interval of the longitudinal-axial fixed bending sleeve 4 can be adjusted with the axial drive 11.

The bending sleeve 4 has a translatory drive 12, represented by a double arrow. In addition to this, the bending sleeve 4 has a pivot drive 13, represented by a double arrow. Finally, the bending sleeve 4 has a rotary bearing 14, which is represented by a double arrow. The rotary bearing 14 is designed in such a way that the longitudinal profile 1 to be bent transfers the rotational movement of the axial sleeve 3 onto the bending sleeve 4, such that this is carried in sympathy, rotating freely.

This rotary bearing 14, however, is equipped with a brake, such that a rotational angle offset can be derived between both parts. This is desirable if the longitudinal profile 1 is to be drilled.

While the spatial axes x, y, z represented in the drawing for the axial sleeve 3 are fixed, the spatial axes u, v, w for the bending sleeve 4 can be relocated in space. While the bending sleeve 4, as indicated, is fixed in the axial direction, i.e. in the direction of the w-axis, it is, however, either rotating in sympathy about this w-axis or braked. In the direction of the u-axis it can be adjusted in a translatory manner by means of the drive 12 and can rotate about the v-axis by means of the drive 13.

With such a device, the bending plane always lies in the u/v plane. By rotation of the longitudinal profile 1 by means of the feed unit 2 and the axial sleeve 3, with the bending plane u/v being maintained at a first bending, a second bending follows in the other direction. The bending radius is determined, on the one hand, by the distance interval between the axial sleeve 3 and the bending sleeve 4 and, on the other hand, by the settings at the bending sleeve 4, and specifically in the direction of the u-axis and about the v-axis.

In order to counter-act the possible folding of the longitudinal profile 1 between the feed unit 2 and the axial sleeve 3 due to the axial forces of the feed unit 2 taking effect on the longitudinal profile 1, lateral support means, not represented in the drawing, can be provided in this area. Preferably, these are formed as a package of supporting shoes which can be opened and moved out of the way according to the feed path of the feed unit 2.

Figure 3:
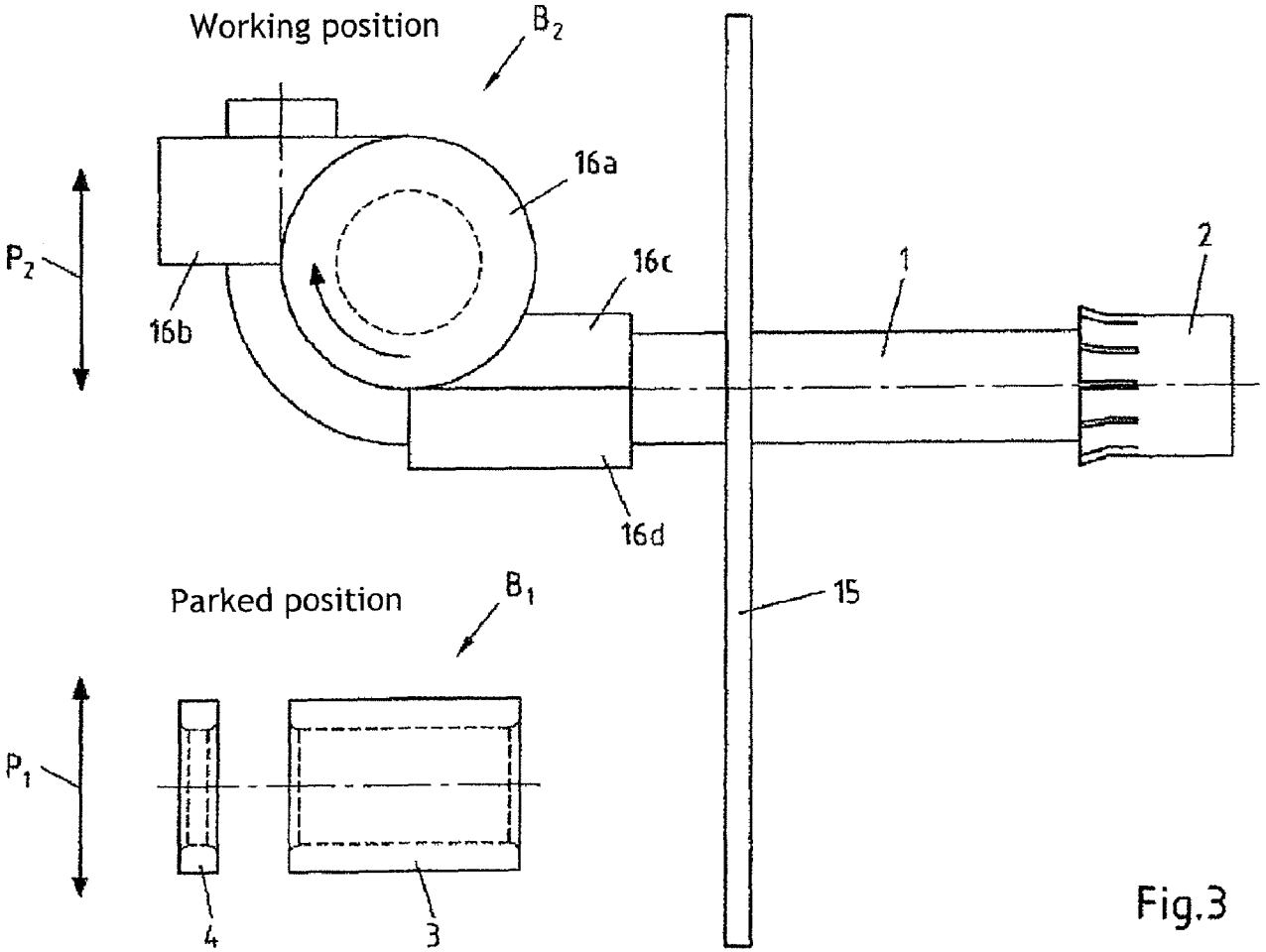

The device represented in the embodiment in FIG. 3 is designed both for free-form bending as well as for draw bending. The device has a common feed unit 2 for both freeform bending as well as for draw bending, which can be designed as grip tongs. It is arranged stationary, i.e. not capable of movement to the side. Located upstream of the feed unit 2 is a carrier frame 15, which has two mutually independent bending units B1, B2, which can be moved to the side by means of drives P1, P2, represented by double arrows. The bending unit B1 is located in the parked position, while the bending unit B2 is located in the working position. The bending unit B2 is designed for freeform bending in accordance with the bending device described heretofore, while the bending unit B2 is designed for draw bending. The bending unit B2 for draw bending has, in an inherently known manner, as main components, a radius template 16*a*, a clamping chuck

16*b*, a folding flat-face element 16*c* and a slide rail 16*d*. In order to convert the device from draw bending to free-form bending, all that is required is for the bending unit B2 to be brought into its parked position and the bending unit B1 for free-form bending to be moved out of its parked position into the working position in front of the stationary feed unit 2.

The invention claimed is:

1. A device for the free-form bending of longitudinal profiles, with a feed unit taking up the longitudinal profile, with an axial sleeve arranged downstream of the feed unit in the direction of feed taking up the longitudinal profile by positive and/or non-positive attachment, and with a bending sleeve arranged downstream of the axial sleeve in the direction of feed, with a passage aperture for the longitudinal profile adapted to the outer contour of the longitudinal profile, wherein the bending sleeve can be adjusted in linear fashion by adjustment drives in a plane lying orthogonal to the axis of the passage aperture, and can be pivoted about an axis perpendicular both to the axis of the passage aperture as well as to the direction of linear movement, and wherein the axial sleeve is equipped with a drive with a distance interval adjustable from the bending sleeve, the feed unit and the axial sleeve driven by rotary drives in the same direction and simultaneously relative to the bending sleeve, the bending sleeve mounted so as to be rotatable about the axis of the passage aperture, and the bending sleeve either freely rotating in sympathy with the axial sleeve or braked in a controlled manner in relation to the axial sleeve.

2. The device of claim 1 wherein the feed unit is designed as grip tongs equipped with a feed drive.

3. The device of claim 1 wherein the bending sleeve is designed as a slide sleeve.

4. The device of claim 1 wherein, provided between the feed unit and the axial sleeve, are support means for the longitudinal profile which prevent the axial sleeve from folding laterally.

5. The device of claim 4 wherein the support means are designed as supporting shoes.

6. The device of claim 5 wherein the supporting shoes can be opened.

7. The device of claim 1 wherein a bendable interior mandrel is arranged in the bending area and in the axial sleeve, the axial position of which can be adjusted and controlled from the rear end of the feed unit a mandrel rod provided with a drive.

8. The device of claim 1 wherein the bending sleeve is designed as a roller guide.

* * * * *